US008911530B2

(12) United States Patent
Hayashi

(10) Patent No.: US 8,911,530 B2
(45) Date of Patent: Dec. 16, 2014

(54) MANUFACTURING METHOD OF MAGNETIC ALLOY POWDER

(71) Applicant: Denso Corporation, Kariya, Aichi-pref. (JP)

(72) Inventor: Yasushi Hayashi, Gifu (JP)

(73) Assignee: Denso Corporation, Kariya (JP)

( * ) Notice: Subject to any disclaimer, the term of this patent is extended or adjusted under 35 U.S.C. 154(b) by 201 days.

(21) Appl. No.: 13/745,996

(22) Filed: Jan. 21, 2013

(65) Prior Publication Data

US 2013/0186238 A1 Jul. 25, 2013

(30) Foreign Application Priority Data

Jan. 24, 2012 (JP) ..... 2012-011704

(51) Int. Cl.

| | |
|---|---|
| ***B22F 9/24*** | (2006.01) |
| ***H01F 1/01*** | (2006.01) |
| ***H01F 1/147*** | (2006.01) |
| *H01F 1/20* | (2006.01) |

(52) U.S. Cl.

CPC .. *H01F 1/01* (2013.01); *B22F 9/24* (2013.01); *H01F 1/14733* (2013.01)

USPC ..... 75/350; 148/105

(58) Field of Classification Search

None

See application file for complete search history.

(56) References Cited

U.S. PATENT DOCUMENTS

| | | | | |
|---|---|---|---|---|
| 3,449,115 | A * | 6/1969 | Galmiche et al. | 75/351 |
| 5,385,716 | A * | 1/1995 | Bogdanovic et al. | 423/463 |
| 6,203,768 | B1 | 3/2001 | McCormick et al. | |
| 6,670,515 | B1 * | 12/2003 | Dubois et al. | 585/269 |
| 2011/0165420 | A1 * | 7/2011 | Ishizuka et al. | 428/402 |

FOREIGN PATENT DOCUMENTS

| | | |
|---|---|---|
| JP | 11-236631 | 8/1999 |
| JP | 11-511208 | 9/1999 |
| JP | 2003-166026 | 6/2003 |
| JP | 2013-014805 | 1/2013 |

OTHER PUBLICATIONS

Kotsugi et al, "Novel Magnetic Domain Structure in Iron Meteorite Induced by the Presence of $L1_0$-FeNi", pp. 013001-1-013001-3, 2010, The Japan Society of Applied Physics.

2 Okubo et al, "Manufacture of Ordered FeNi Alloy With Hydrogen Application Process", Proceedings of Annual Meeting of Japan Society for Molecular Science 2011, 3P076.

* cited by examiner

*Primary Examiner* — George Wyszomierski

(74) *Attorney, Agent, or Firm* — Harness, Dickey & Pierce, PLC

(57) ABSTRACT

In a manufacturing method of magnetic alloy powder including an alloy of Fe and Ni, a precursor made of powdered chloride expressed as $FeCl_2 \cdot 2H_2O \cdot NiCl_2 \cdot 2H_2O$ is prepared, and the precursor is reduced by heating with calcium hydride to form the, magnetic alloy powder having a coercivity of greater than or equal to 40 kA/m.

2 Claims, 4 Drawing Sheets

FIG. 4

| | PRECURSOR | COERCIVITY (kA/m) |
|---|---|---|
| COMPARATIVE EXAMPLE1 | $FeCl_2 \cdot 4H_2O \cdot NiCl_2 \cdot 6H_2O$ | 15 |
| COMPARATIVE EXAMPLE2 | $FeCl_2 \cdot 4H_2O \cdot NiCl_2 \cdot 2H_2O$ | 30 |
| EMBODIMENT | $FeCl_2 \cdot 2H_2O \cdot NiCl_2 \cdot 2H_2O$ | 52 |

MANUFACTURING METHOD OF MAGNETIC ALLOY POWDER

CROSS REFERENCE TO RELATED APPLICATIONS

The present application is based on and claims priority to Japanese Patent Application No. 2012-11704 filed on Jan. 24, 2012, the contents of which are incorporated in their entirety herein by reference.

TECHNICAL FIELD

The present disclosure relates to a manufacturing method of magnetic alloy powder.

BACKGROUND

A high performance magnet made of a Fe alloy powder includes FePt magnet made of FePt alloy. The FePt magnet has a high protection against corrosion and is a relatively strong magnet. However, because the FePt magnet uses expensive Pt, an application is limited.

Thus, tetrataenite, which is an ordered alloy (NiFe) of Ni:Fe=1:1 is expected as substitution of the FePt magnet. Tetrataenite has a high coercivity. Although normal NiFe alloy has a coercivity of less than or equal to 100 Nm, tetrataenite included in an iron meteorite has a high coercivity of 100 kA/m (see Kotsugi et al., Applied Physics Express 3 (2010) 013001).

Tetrataenite is included in a grain boundary layer in an iron meteorite and is generated at a very slow cooling speed of $-10^{-6\circ}$ C./year. Although tetrataenite has a crystal structure of face-centered tetragonal lattice (fct), a phase transition occurs at 320° C., and taenite in which an atomic arrangement of face-centered cubic lattice (fcc) is disordered is formed.

Recently, it has been reported that magnetic particles including tetrataenite and having a relatively high coercivity can be artificially composed by hydrogen reduction of nanoparticles of compound oxide of Fe and Ni (see Okubo et al., Proceedings of Annual Meeting of Japan Society for Molecular Science 2011, 3P076). However, the magnetic particles have a coercivity of about one-third of tetrataenite included in an iron meteorite.

The inventor of the present application earnestly studied about artificial composition of magnetic alloy powder including an alloy of Fe and Ni and composed magnetic particles including tetrataenite at a temperature lower than or equal to 320° C. using amorphous compound hydroxide of Fe and Ni as source material and calcium hydride as reducing agent. However, the magnetic particles have a coercivity of one-fifth of tetrataenite included in an iron meteorite, that is, natural tetrataenite.

SUMMARY

It is an object of the present disclosure to provide a manufacturing method of magnetic alloy powder including an alloy of Fe and Ni and having a high coercivity.

According to an aspect of the present disclosure, a manufacturing method of magnetic alloy powder including an alloy of Fe and Ni includes preparing a precursor made of powdered chloride expressed as $FeCl_2 \cdot 2H_2O \cdot NiCl_2 \cdot 2H_2O$, and reducing the precursor by heating with calcium hydride to form the magnetic alloy powder having a coercivity of greater than or equal to 40 kA/m.

The above-described manufacturing method can stably manufacture the magnetic alloy powder having a high coercivity of greater than or equal to 40 kA/m.

BRIEF DESCRIPTION OF THE DRAWINGS

Additional objects and advantages of the present disclosure will be more readily apparent from the following detailed description when taken together with the accompanying drawings. In the drawings:

FIG. 4 is a diagram showing coercivities of the magnetic alloy powder manufactured by the manufacturing method according to the embodiment and magnetic alloy powders manufactured by manufacturing methods according to comparative examples.

DETAILED DESCRIPTION

Figure 1:
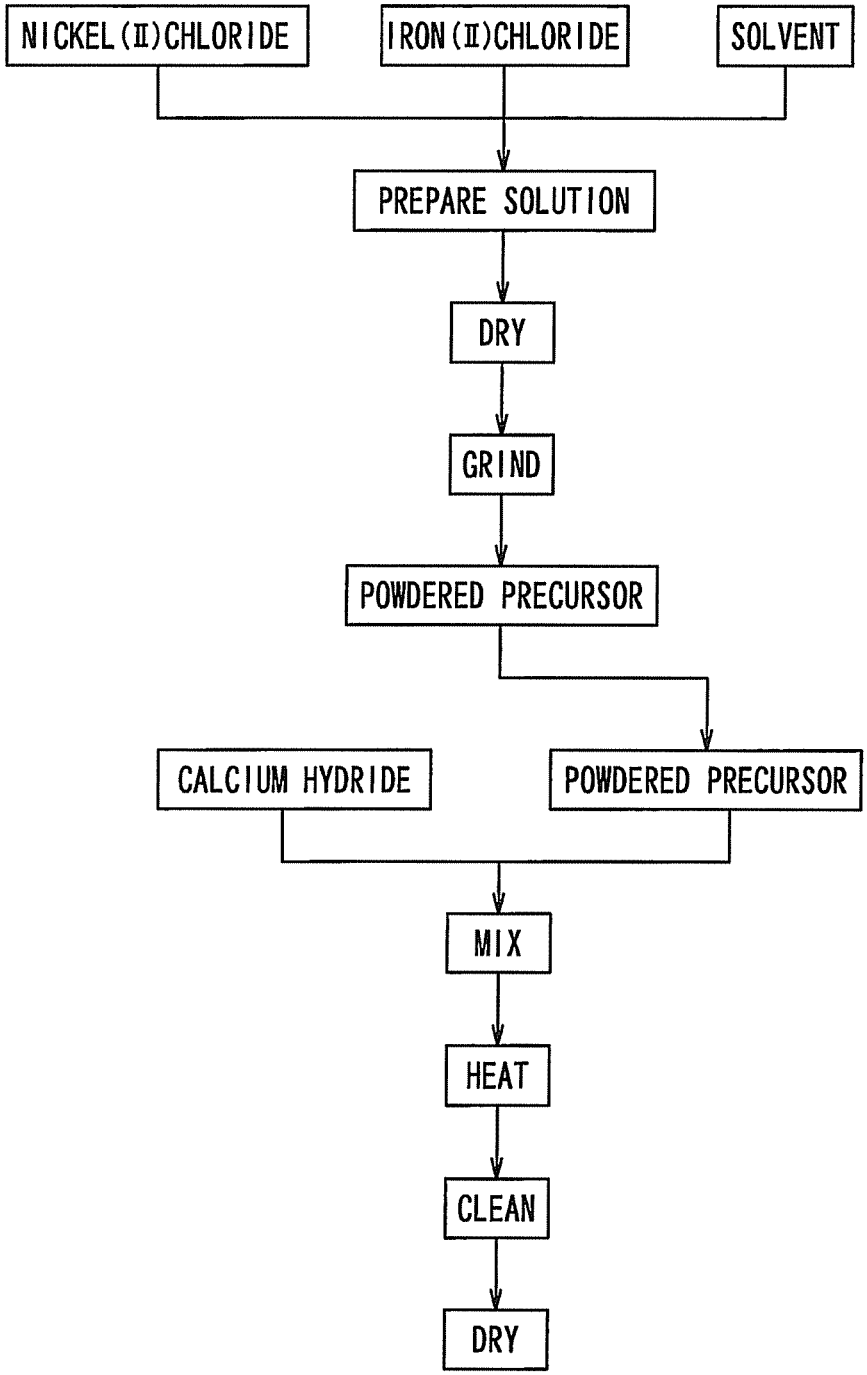
FIG. 1 is a flow diagram showing a manufacturing method of magnetic alloy powder according to an embodiment of the present disclosure.

A manufacturing method according to an embodiment of the present disclosure is a manufacturing method of magnetic alloy power including an alloy of Fe and Ni. The manufacturing method includes preparing powdered chloride precursor expressed as $FeCl_2 \cdot 2H_2O \cdot NiCl_2 \cdot 2H_2O$ and reducing the precursor by heating with calcium hydride to form magnetic alloy power having a coercivity of greater than or equal to 40 kA/m.

The manufacturing method can stably manufacture the magnetic alloy power having the coercivity of greater than or equal to 40 kA/m.

The manufacturing method of the present embodiment will be described in more detail with reference to FIG. 1 and FIG. 2. In the flow diagram shown in FIG. 1, a precursor preparing process includes a solution preparing process, a drying process, and a grinding process. A precursor reducing process includes a mixing process and a drying process.

For preparing the solution, commercial ferrous chloride and commercial nickel chloride are used. For example, $FeCl_2 \cdot 4H_2O$ as ferrous chloride and $NiCl_2 \cdot 6H_2O$ as nickel chloride are mixed in a solvent to prepare a mixed solution. For example, a mixed solution in which $FeCl_2$:$NiCl_2$ is 1:1 in molar ratio is prepared by dissolving 0.1 mol of $FeCl_2 \cdot 4H_2O$ and 0.1 mol of $NiCl_2 \cdot 6H_2O$ in ion exchange water of 100 ml. Accordingly, the mixed solution in which the total of $FeCl_2$ and $NiCl_2$ is 2 mol/L is prepared.

Next, the mixed solution is dried. For example, the mixed solution is dried in a thermostat at a temperature of 105° C. to 120° C. to remove the solvent and to deposit composite chloride of Fe and Ni. The composite chloride just after deposition is blue green. The removing solvent is continued in the thermostat at the temperature of 105° C. to 120° C. until a deposit is dried to turn yellow.

The blue-green deposit is a composite chloride expressed as $FeCl_2 \cdot 4H_2O \cdot NiCl_2 \cdot 2H_2O$. The yellow deposit, which is obtained by further drying the blue-green deposit, is a composite chloride expressed as $FeCl_2 \cdot 2H_2O \cdot NiCl_2 \cdot 2H_2O$. The composite chlorides can be identified, for example, by an X-ray analysis. In other words, a time to finish the drying the mixed solution can be determined, for example, by viewing or the X-ray analysis.

The mixed solution may be dried in a vacuum thermostat for restricting oxidation of Fe and improving a drying speed (i.e., a solvent evaporation speed). By drying the mixed solution, the composite chloride in the solid form can be obtained. Next, the composite chloride in solid form is ground to form powdered composite chloride, that is, powdered precursor. For example, the composite chloride is ground with a mortar.

The composite chloride may be ground in inert gas, such as argon (Ar) or helium (He), for restricting oxidation. For example, the composite chloride may be ground in a glove box filled with inert gas atmosphere. Accordingly, powdered precursor expressed as $FeCl_2 \cdot 2H_2O \cdot NiCl_2 \cdot 2H_2O$ is prepared.

Subsequently, the powdered precursor is reduced by mixing and heating. For restricting oxidation of the precursor, the precursor may be mixed and heated in inert gas atmosphere. For example, the precursor is mixed and heated in a glove box or a furnace filled with inert gas atmosphere.

The powdered precursor is uniformly mixed with calcium hydride ($CaH_2$) with a weight ratio of the precursor:calcium hydride=3:2 using, for example, a mortar. The weight ratio of the precursor:calcium hydride may be 2:1 to 1:1.

When the weight of the precursor is 2 and the weight of calcium hydride is less than 1, the precursor is less likely to be reduced because calcium hydride is insufficient. On the other hand, when the weight of the precursor is 1 and the weight of calcium hydride exceeds 1, a reducing speed is too high and Fe and Ni are less likely to form an ordered structure after reduction.

Then, the mixture of the precursor and calcium hydride is heated to reduce the precursor. Accordingly, the magnetic alloy power including the alloy of Fe and Ni can be manufactured.

The mixture may be heated at a temperature higher than or equal to 270° C. and is less than or equal to 310° C. When the temperature is lower than 270° C., the reduction does not proceed. When the temperature is higher than 310° C., the reduction speed is too high to form the ordered structure of Fe and Ni, and coercivity of the alloy after reduction may be insufficient.

Figure 2:
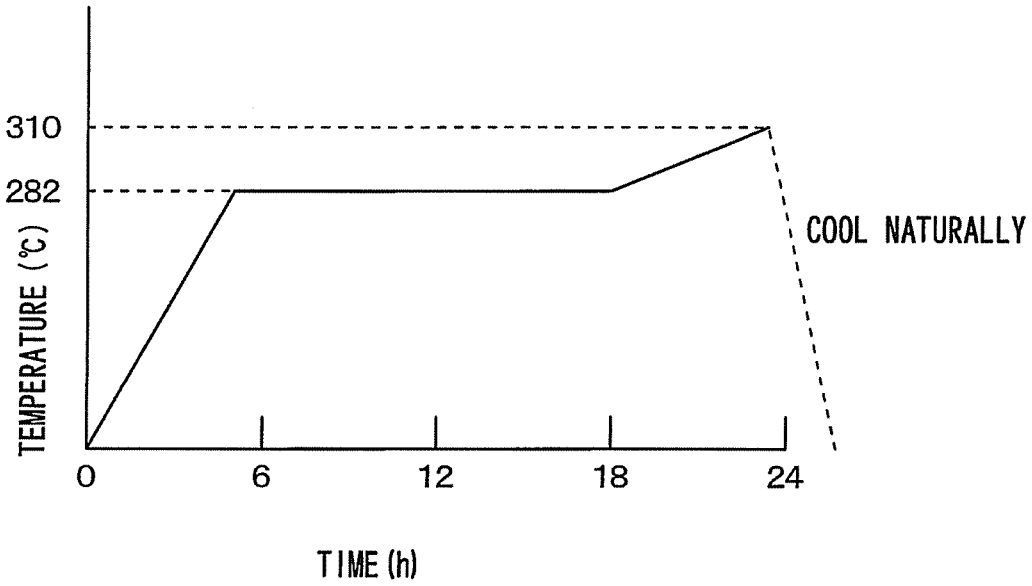
FIG. 2 is a diagram showing a heat temperature profile in a heating process in the manufacturing method shown in FIG. 1.

FIG. 2 shows an example of a temperature profile in a process of heating the mixture. However, the temperature profile is not limited to the example. In the example, the temperature increases from a room temperature to 282° C. in 4 hours and keeps 282° C. until 18 hours. The temperature increases to 310° C. in 24 hours and heating stops. Then, the temperature naturally decreases to the room temperature.

Accordingly, the magnetic alloy powder including the alloy of Fe and Ni is manufactured. The magnetic alloy powder is identified, for example, by an X-ray analysis. After that, the magnetic alloy powder is cleaned.

The magnetic alloy powder is put in a container, and hydrochloric acid is added while mixing until supernatant becomes transparent blue-green. Then, the magnetic alloy powder is washed with water and is dried. The magnetic alloy powder is cleaned for removing impurities, such as residue of calcium salt and soft magnetism component including a large amount of Fe by dissolving with hydrochloric acid.

The magnetic alloy powder manufactured by the above-described method has a coercivity of greater than or equal to 40 kA/m. Magnetic characteristics of the magnetic alloy power manufactured by the method according to the present embodiment are compared with comparative examples.

Figure 3:
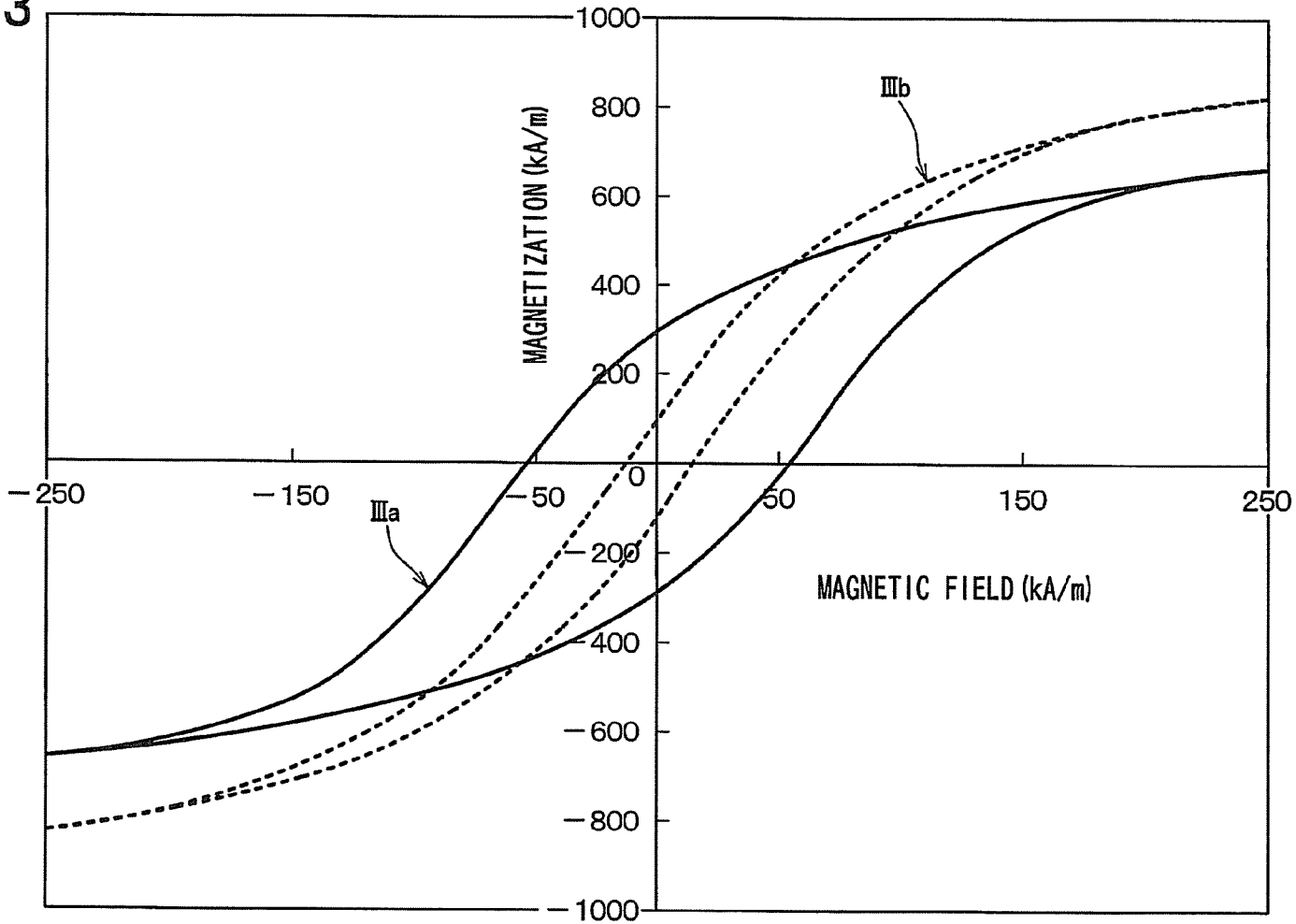
FIG. 3 is a diagram showing magnetic hysteresis characteristics of the magnetic alloy powder according to the embodiment (IIIa) and magnetic alloy powder according to a comparative example (IIIb)

In FIG. 3, a magnetic hysteresis curve of the magnetic alloy powder manufactured by the method according to the present embodiment is shown by a solid line IIIa, and a magnetic hysteresis curve of magnetic alloy powder manufactured by a method according to a comparative example is shown by a dashed line IIIb. The magnetic alloy powder according to the comparative example is manufactured by reducing a composite oxide of Fe and Ni with calcium hydride. The magnetic hysteresis curves IIIa, IIIb are measured with a vibrating sample magnetometer (VSM).

As shown in FIG. 3, the magnetic alloy power according to the comparative example has a coercivity of about 20 kA/m, which is only about one-fourth of natural tetrataenite included in iron meteorite. On the other hand, the magnetic alloy powder according to the present embodiment has a high coercivity of 52 kA/m.

In FIG. 4, the magnetic alloy power according to the present embodiment, which is manufactured by using $FeCl_2 \cdot 2H_2O \cdot NiCl_2 \cdot 2H_2O$ as the precursor, is compared with magnetic alloy powers manufactured by using other composite chlorides as precursors.

A precursor $FeCl_2 \cdot 4H_2O \cdot NiCl_2 \cdot 6H_2O$ according to a first comparative example is formed by putting solid-state $FeCl_2 \cdot 4H_2O$ and solid-state $NiCl_2 \cdot 6H_2O$ into a mortar and grinding to mix uniformly in the solid state. The precursor according to the first comparative example is green. A precursor $FeCl_2 \cdot 4H_2O \cdot NiCl_2 \cdot 2H_2O$ according to a second comparative example is blue-green deposit which is insufficiently dried in the above-described drying process.

The precursors according to the first and second comparative examples are treated with a mixing process, a heating process to reduce with calcium hydride, a cleaning process, and a drying process in a manner similar to the processes shown in FIG. 1 to obtain magnetic alloy powders. Then, magnetic hysteresis characteristics of the magnetic alloy powders according to the first and second comparative examples are measured in a manner similar to the magnetic hysteresis characteristics shown in FIG. 3 to calculate coercivities.

As shown in FIG. 4, the magnetic alloy powder according to the present embodiment has a high coercivity of 52 kA/m. On the other hand, the magnetic alloy powder according to the first comparative example has a low coercivity of 15 kA/m, and the magnetic alloy powder according to the second comparative example has a low coercivity of 30 kA/m.

As described above, coercivity greatly changes with a kind of chloride used as a precursor, especially a coordination number of water molecule. The magnetic alloy powder according to the present embodiment, which is manufactured using $FeCl_2 \cdot 2H_2O \cdot NiCl_2 \cdot 2H_2O$ as the precursor, can stably have a high coercivity of greater than or equal to 40 kA/m.

In this way, the manufacturing method according to the present embodiment can stably manufacture the magnetic alloy powder including an alloy of Fe and Ni and having a high coercivity of greater than or equal to 40 kA/m.

In the manufacturing method according to the present embodiment, because the mixed solution, in which $FeCl_2 \cdot 4H_2O$ and $NiCl_2 \cdot 6H_2O$ are mixed in the solvent, is heated, the chloride precursor can be deposited in a state where $FeCl_2 \cdot 4H_2O$ and $NiCl_2 \cdot 6H_2O$ are uniformly mixed in the solution. Accordingly, the precursor can be obtained efficiently.

(Other Embodiments)

In the process of preparing the precursor, $FeCl_2 \cdot 4H_2O$ and $NiCl_2 \cdot 6H_2O$ may be uniformly mixed in the solid state, for example, by grinding with a mortar, and the precursor may be obtained by heating the mixture.

What is claimed is:

1. A manufacturing method of magnetic alloy powder including an alloy of Fe and Ni, comprising:

preparing a precursor made of powdered chloride expressed as $FeCl_2 \cdot 2H_2O \cdot NiCl_2 \cdot 2H_2O$; and reducing the precursor by heating with calcium hydride to form the magnetic alloy powder having a coercivity of greater than or equal to 40 kA/m.

2. The manufacturing method according to claim 1, wherein the preparing the precursor includes heating a mixed solution in which $FeCl_2 \cdot 4H_2O$ and $NiCl_2 \cdot 6H_2O$ are mixed in a solvent.

* * * * *